US006769278B1

(12) United States Patent
Chang

(10) Patent No.: US 6,769,278 B1
(45) Date of Patent: Aug. 3, 2004

(54) ANTI-BURGLAR DEVICE OF A DOOR LOCKER

(76) Inventor: Wen-Kwei Chang, PO Box 82-144, Taipei (TW)

( * ) Notice: Subject to any disclaimer, the term of this patent is extended or adjusted under 35 U.S.C. 154(b) by 0 days.

(21) Appl. No.: 10/345,479

(22) Filed: Jan. 17, 2003

(51) Int. Cl.[7] ..... E05B 13/00

(52) U.S. Cl. ..... 70/134; 70/189; 70/223; 70/416; 70/422; 292/350; 292/DIG. 27

(58) Field of Search ..... 70/416, 134, 188, 70/189, 472, 223, 149, 422, 370, 451, 466, 448, 449, DIG. 73; 292/DIG. 27, 348, 350–352, 357, 358, DIG. 53

(56) References Cited

U.S. PATENT DOCUMENTS

| | | | | | |
|---|---|---|---|---|---|
| 2,497,329 | A | * | 2/1950 | Smith et al. | |
| 2,645,925 | A | * | 7/1953 | Miller | |
| 2,786,706 | A | * | 3/1957 | Wright | |
| 2,949,290 | A | * | 8/1960 | Hezler, Jr. | |
| 3,477,607 | A | * | 11/1969 | Fuzzell et al. | |
| 4,557,124 | A | * | 12/1985 | Russ | 70/456 R |
| 4,575,141 | A | * | 3/1986 | Burns | 292/336.3 |
| 4,715,200 | A | * | 12/1987 | Katsaros | 70/211 |
| 5,551,188 | A | * | 9/1996 | Davlantes | 49/169 |
| 5,678,436 | A | * | 10/1997 | Alexander | 70/456 R X |
| 5,865,050 | A | * | 2/1999 | Michaud et al. | 70/416 |
| 5,934,122 | A | * | 8/1999 | Edwards et al. | 70/416 |
| 6,205,827 | B1 | * | 3/2001 | Lane | 70/180 |

FOREIGN PATENT DOCUMENTS

| | | | | |
|---|---|---|---|---|
| DK | 29265 | * | 1/1922 | 292/150 |
| GB | 454672 | * | 10/1936 | 70/416 |
| GB | 1603606 | * | 11/1981 | 70/416 |

* cited by examiner

*Primary Examiner*—Lloyd A. Gall
*Assistant Examiner*—Sandra F Garrett
(74) *Attorney, Agent, or Firm*—Leong C. Lei

(57) ABSTRACT

An anti-burglar device of a door locker is disclosed. The locker comprises a rotating button, a rotating shaft body, and an external gear, the rotating shaft body being fixed to the rotating shaft body having one end mounted to the external gear, the other end of the external gear provided with an axle having a spring and a sleeve, and the spring urged between the rotating shaft body and the sleeve, the interior of the sleeve provided with internal gear which is engaged with the external gear, the tail end of the axle mounted to a fixing button so that the sleeve cannot be disengaged, whereby in unlocking or locking the locker, a force is applied to move the sleeve so that the inner gear and the external gear are engaged, and the sleeve is turned to unlock or lock the latch of the locker.

1 Claim, 4 Drawing Sheets

ANTI-BURGLAR DEVICE OF A DOOR LOCKER

BACKGROUND OF THE INVENTION (a) Technical Field of the Invention

The present invention relates to a door locker mounted within a door at the door edge thereof and in particular, a door locker with anti-burglar structure by having a rotating shaft body mounted onto a rotating button of the door locker.

(b) Description of the Prior Art

Conventional door locker structure is designed in such a way that the locking and unlocking of lock-core has to use a matching key. However, the inner face of the door locker in order to facilitate operation, a manual rotating button is provided to drive the locker latch and therefore, if the rotating button triggers the rotating button, the latch can be easily locked or unlocked.

As a result, the door is normally provided with an observation hole with a lens confirm the visitor coming to the house.

However, a burglar can easily remove the observation lens and a special tool can be inserted to trigger the rotating button and the door is thus easily opened by the burglar.

In order to mitigate the shortcomings of the conventional door locker, an anti-burglar device of a door locker is provided.

SUMMARY OF THE INVENTION

Accordingly, it is an object of the present invention to provide an anti-burglar device of a door locker having a rotating button, a rotating shaft body, and an external gear, the rotating shaft body being fixed to the rotating shaft body having one end mounted to the external gear, the other end of the external gear provided with an axle having a spring and a sleeve, and the spring urged between the rotating shaft body and the sleeve, the interior of the sleeve provided with internal gear which is engaged with the external gear, the tail end of the axle mounted to a fixing button so that the sleeve cannot be disengaged, whereby in unlocking or locking the locker, a force is applied to move the sleeve so that the inner gear and the external gear are engaged, and the sleeve is tuned to unlock or lock the latch of the locker.

A further object of the present invention is to provide an anti-burglar device of a door locker, wherein the end face of the rotating shaft body is provided with a combination hole having a shape identical to and match the rotating button within the door locker.

Yet a further object of the present invention is to provide anti-burglar device of a door locker, wherein the external diameter of the rotating shaft body is provided with screw hole which is perpendicular in communication with the combination hole.

Still a further object of the present invention is to provide anti-burglar device of a door locker, wherein the nearby position of the tail end of the axle of the rotating shaft body is provided with a sunken hole and the sunken hole contains a spring and an insertion peg.

The foregoing object and summary provide only a brief introduction to the present invention. To filly appreciate these and other objects oft he present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
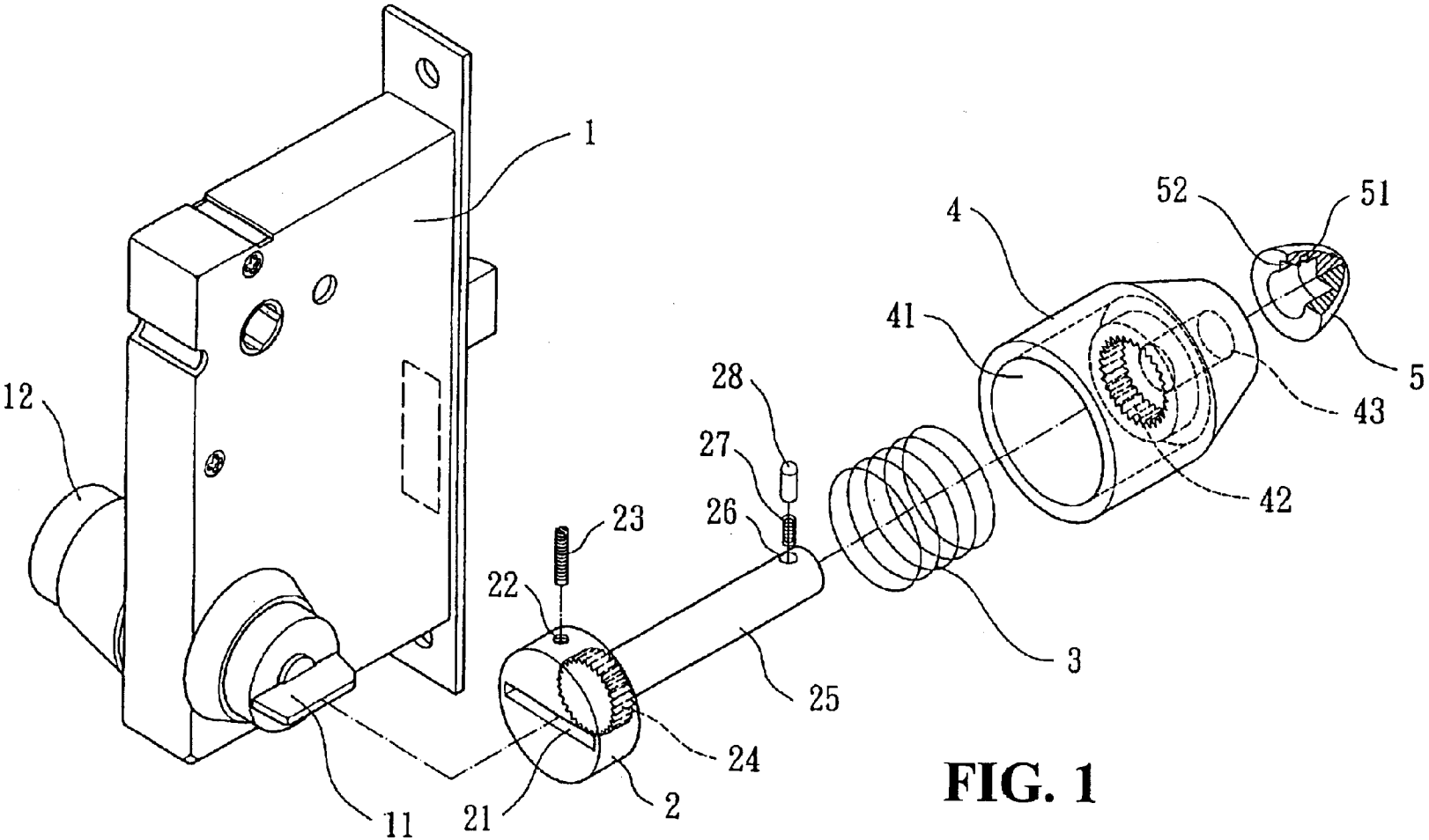
FIG. 1 is a perspective exploded view of the present invention

Referring to FIG. 1, there is shown an anti-burglar device of a door locker 1 having a rotating button 11, a rotating shaft body 2 and an external gear 24. One end face of the rotating shaft body 2 is provided with a combination hole 21, and the shape of the combination hole 21 matches the shape of the rotating button 11 of the door locker 1. Thus, the combination hole 21 of the rotating shaft body 2 can be matching mounted onto the rotating button of the door locker 1.

The external diameter of the rotating shaft body 2 is provided with screw hole 22 which is perpendicular in communication to the combination hole 21, and the screw hole 22 is engaged with a screw bolt 23. Thus, the rotating shaft body 2 is securely fastened to the position of the rotating button 11.

The other end of the rotating shaft body 2 is provided with the external gear 24 having one end being extended to form a branch axle 25. The tail end of the axle 25 is provided with a sunken hole 26 and the interior of the sunken hole 26 contains a spring 27 and an insertion peg 28.

The axle 25 of the rotating shaft 2 is mounted in sequence, the spring 3 and the sleeve 4, and the spring 3 urges between the rotating shaft body 2 and the sleeve 4.

One end of the sleeve 4 is a tube opening 41 which is hollow, and the opening diameter of the tube opening 41 can mount to the external diameter of the rotating shaft body 2. The interior of the sleeve 4 is provided with an internal gear 42 and the internal gear 42 and the external gear 24 of the rotating shaft body 2 are matched. The other end of the sleeve 4 is provided with a shaft hole 43, and the shaft hole 43 allows the tail end of the axle 25 to pass through.

Finally, the tail end of the axle 25 is mounted with a securing button 5 and the inner wall position of the securing button 5 is provided with a sunken hole 51 and a slanting slot 52. By the guiding of the slanting slot 52, the sunken hole 51 of the securing button 5 allows one end of the insertion peg 28 within the sunken hole 26 at the tail end of the axle 25 to be secured, such that the sleeve 4 will not be dislocated.

Figure 2:
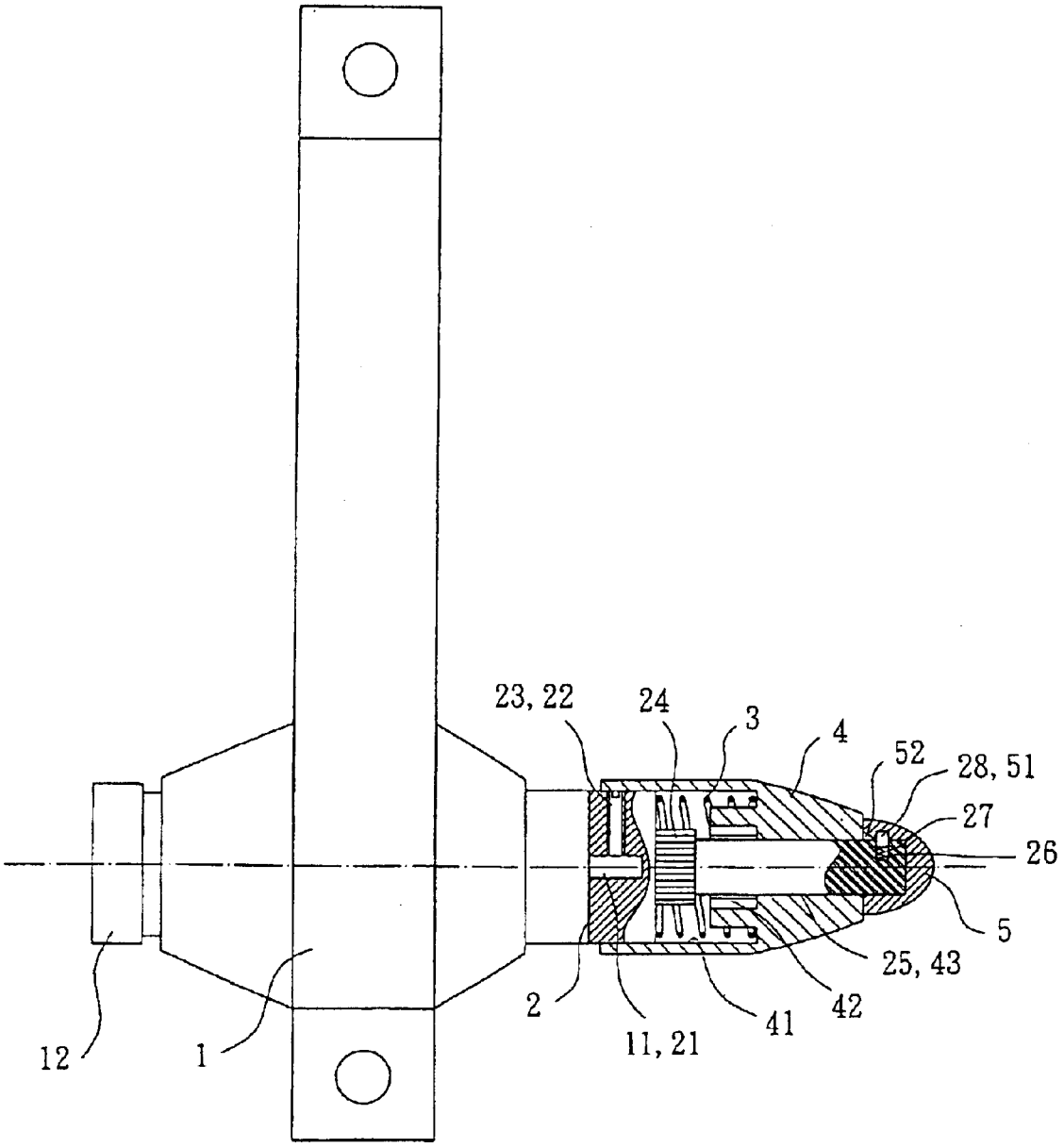
FIG. 2 is a sectional view of the interior structure of the present invention.

As shown in FIGS. 1 and 2, normally, the internal gear 42 and the external gear 24 are far apart, and the sleeve 4 is free to rotate at the axle 25, as shown in FIG. 2.

Figure 3:
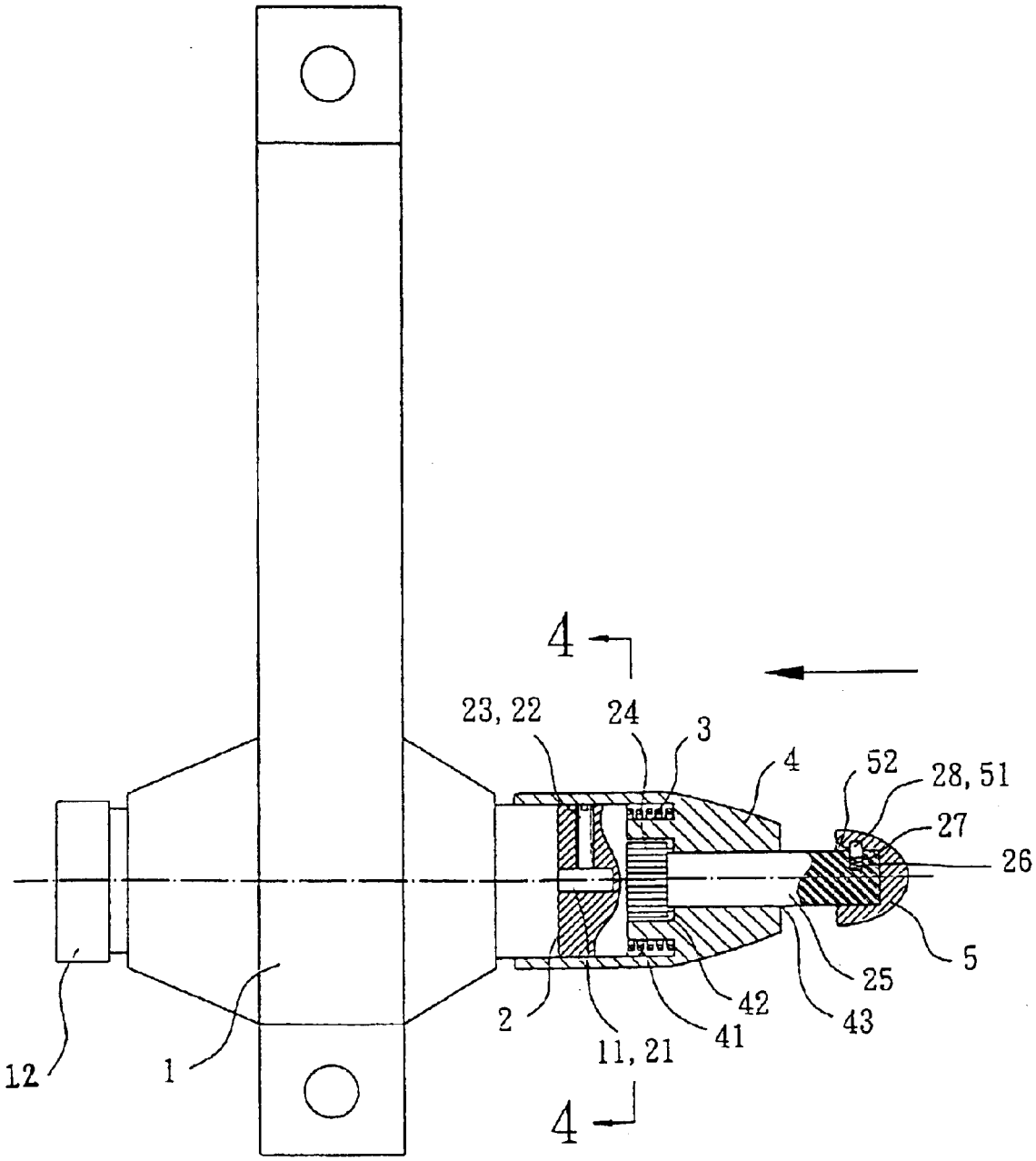
FIG. 3 is a schematic view showing the action of the anti-burglar structure of a door lock of the present invention.
Figure 4:
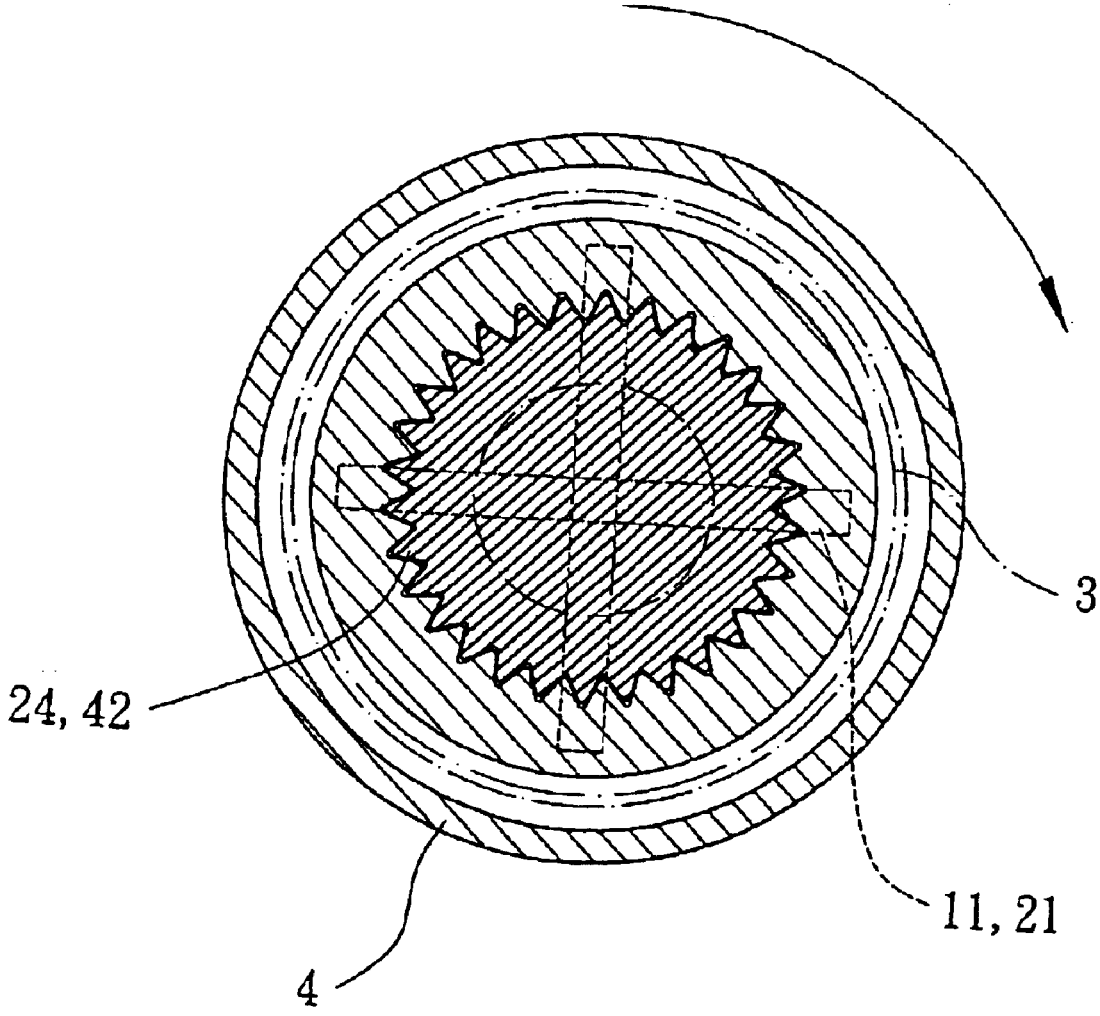
FIG. 4 is a sectional view along line 4—4 of FIG. 3 of the present invention.

Referring to FIGS. 1, 3 and 4, in locking or unlocking process, a force is exerted onto the sleeve 4 such that the internal gear 42 of the sleeve 4 and the external gear 24 are in engaged with each other, and the sleeve 4 is rotated so as to rotate the rotating button 11. Thus, the latch of the door locker 1 is unlocked or locked.

In view of the above, the rotating button 11 is incorporated with a special sleeve 4 structure so that under normal condition, the sleeve is free and when the sleeve 4 is rotated, the latch of the locker 1 will not be moved.

When to lock or unlock the latch, a continuous force is applied to the sleeve 4 so that the internal gear 42 and the external gear 24 are engaged so as to drive the latch. Accordingly, the present invention provides an anti-burglar device of a door locker which mitigates the conventional door locker structure.

It will be understood that each of the elements described above, or two or more together many also find a useful application in other types of methods differing from the type described above.

While certain novel features of this invention have been shown and described and are pointed out in the annexed claim, it is not intended to be limited to the detail above, since it will be understood that various omissions, modifications, substitutions and changes in the forms and details of the device illustrated and in its operation can be made by those skilled in the art without departing in any way from the spirit of the present invention.

I claim:

1. An anti-burglar device of a door locker having a rotating button, a rotating shaft body, and an external gear, the rotating shaft body being fixed to the rotating button, the rotating shaft having one end mounted to the external gear, the other end of the external gear provided with an axle having a spring and a sleeve, and the spring urged between the rotating shaft body and the sleeve, an interior of the sleeve provided with internal gear which is engaged with the external gear, a tail end of the axle mounted to a securing button so that the sleeve cannot be disengaged, wherein an end face of the rotating shaft body is provided with a combination hole having a shape identical to and matching with the rotating button within the door locker, an external diameter of the rotating shaft body is provided with a screw hole which is perpendicular to and in communication with the combination hole, a nearby position of the tail end of the axle of the rotating shaft body is provided with a sunken hole and the sunken hole contains a spring and an insertion peg, one end of the sleeve is a tube opening which is hollow and a diameter of the tube opening is mounted onto the external diameter of the rotating shaft body, whereby in unlocking or locking the locker, a force is applied to move the sleeve so that the inner gear and the external gear are engaged, and the sleeve is turned to unlock or lock the latch of the locker.

* * * * *